US006678484B2

(12) United States Patent
Koshimura et al.

(10) Patent No.: US 6,678,484 B2
(45) Date of Patent: Jan. 13, 2004

(54) IMAGE FORMING APPARATUS AND METHOD FOR REMOVING A NON-TRANSFERRED TONER IMAGE

(75) Inventors: Yasushi Koshimura, Hachioji (JP); Yukiko Omori, Hachioji (JP); Junichi Hamada, Hachioji (JP); Mitsugu Nemoto, Hachioji (JP)

(73) Assignee: Konica Corporation (JP)

( * ) Notice: Subject to any disclaimer, the term of this patent is extended or adjusted under 35 U.S.C. 154(b) by 18 days.

(21) Appl. No.: 10/152,303

(22) Filed: May 21, 2002

(65) Prior Publication Data

US 2002/0191986 A1 Dec. 19, 2002

(30) Foreign Application Priority Data

May 25, 2001 (JP) ..... 2001-156871
Jun. 7, 2001 (JP) ..... 2001-172487

(51) Int. Cl.[7] ..... G03G 15/00; G03G 21/00
(52) U.S. Cl. ..... 399/75; 399/49; 399/343
(58) Field of Search ..... 399/49, 71, 72, 399/75, 222, 343, 349, 350

(56) References Cited

U.S. PATENT DOCUMENTS 5,903,797 A * 5/1999 Daniels et al. ..... 399/71 X
6,233,413 B1 * 5/2001 Folkins ..... 399/71
6,427,062 B1 * 7/2002 Takeuchi ..... 399/49 X
6,463,253 B2 * 10/2002 Sato ..... 399/350
6,497,984 B2 * 12/2002 Itami et al. ..... 399/350 X
6,580,897 B2 * 6/2003 Sato et al. ..... 399/350

* cited by examiner

*Primary Examiner*—Fred L. Braun
(74) *Attorney, Agent, or Firm*—Muserlian, Lucas and Mercanti

(57) ABSTRACT

An image forming apparatus and method using a toner containing toner particles having a coefficient of shape falling within a range of 1.0 to 1.6 of an amount of at least 65% by number, and having no protrusion of an amount of at least 50% by number, the image forming apparatus including a charging device for uniformly charging a photoreceptor, a developing device for developing an image obtained by imagewise exposure with the toner, a transfer device for transferring a toner image onto a transfer material, a fixing device for fixing, and a cleaning device for cleaning the photoreceptor after the transfer of a toner image, wherein when a toner image which is not to be transferred is formed on the photoreceptor, image formation is performed after cleaning is done a plurality of times for an area on which the toner image has been formed in the previous process.

22 Claims, 4 Drawing Sheets

IMAGE FORMING APPARATUS AND METHOD FOR REMOVING A NON-TRANSFERRED TONER IMAGE

BACKGROUND OF THE INVENTION

This invention relates to an image forming apparatus employing an electrophotographic method used in a copying machine, a printer, etc.

In recent years, for a copying machine, a printer, etc. for which a high speed and a high image quality are required, image forming method of an electrophotographic type has been mostly used.

The reason is, for example, that a high-speed and high-quality image can be obtained stably by an electrophotographic method, and on top of it, it can cope with the requirement for formation of a digital image or a color image. Hence, it can be considered that this tendency will continue also from now on; therefore, as regards an image forming method of an electrophotographic type, it is true that further improvement of performance is required in several points, and the most important point among them is image quality.

The most effective way for the improvement of image quality is to make the particle diameter of the toner small, or to make the particles have a suitable shape uniformly, accompanied by incorporating, in the inside of an apparatus, a mechanism to keep proper the condition of image forming in the apparatus. However, owing to these ways for improvement influencing other characteristics to deteriorate them, some characteristics which have heretofore been of no problem are now regarded as a problem.

To state the above-mentioned problem concretely, in order to improve image quality, it is advantageous to use a toner having a small particle diameter, or to use a toner whose shape has no remarkable concave or convex portions and is nearly spherical as much as possible. However, any one of these necessary conditions for a toner acts disadvantageously on the cleaning of a photoreceptor. That is, if other conditions are kept the same, the smaller the diameter of a toner becomes, or the less concave and convex portions the particles of a toner have on their surface, the larger their contact surface becomes relatively to the volume of the particles when they adhere to the surface of a photoreceptor; therefore, cleaning becomes more difficult.

On top of it, for the purpose of detecting whether or not the toner is supplied with an amount enough to produce the maximum density as a process for keeping image quality at a high level, it is necessary to form a patch image for the detection directly outside the image transfer area of a photoreceptor. Further, in order to perform cleaning uniformly, for example, the surface of a photoreceptor must be smoothly rubbed by a cleaning blade, and for checking it, it is put into practice that band-shaped toner images extending over the whole width of the photoreceptor are formed at specified intervals and removed for cleaning.

In particular, in an apparatus having a high image forming speed, owing to the large frictional force acting between the photoreceptor surface and the cleaning member, a smoothing agent composed of zinc stearate particles or the like is properly used to make the surface easy to be cleaned by scraping, to prevent a failure such as reverse bending of the cleaning blade tip.

The toner images to be formed for the above-mentioned reason are such that are not transferred onto a transfer material originally and do not appear on a final image (non-transferred visible image), and they are all formed with a toner amount enough to exhibit the maximum density; therefore, they have a large toner deposition quantity per unit area, to tend to cause poor cleaning. In the case where this process is carried out in combination with a toner having a small particle diameter or a toner having a proper particle shape uniformly, as a matter of course, the tendency to cause poor cleaning becomes strengthened. If it happens, in the case where the poorly cleaned part comes within the image area at the time of next image forming, the image is to appear on the final image. In another way, in the case where the image is the patch image for detecting image density and overlaps the next one, if the toner image of the previous time remains, the image is to be detected as one having a higher density than original one.

SUMMARY OF THE INVENTION

It is an object of this invention to provide an image forming apparatus employing an electrophotographic method capable of causing no poor cleaning and keeping a high image quality over a long period of time, while using a toner having a small particle diameter, a uniform shape, or a shape without protrusions, as a result of the improvement in the above-mentioned points of problem.

The object of this invention can be accomplished by any one of the structures (1) to (22) described below.

(1) An image forming apparatus using a toner having a volume average particle size of 2 to 8 $\mu$m, comprising a charging device for uniformly charging a photoreceptor, a developing device for developing an image obtained by image exposure by said toner, a transfer device for transferring a toner image to a transfer material, a fixing device for fixing, and a cleaning device for cleaning the photoreceptor after the transfer of a toner image, and carrying out image formation by using repeatedly the photoreceptor after cleaning, wherein it is employed a mechanism such that, in the case where a toner image which is not to be transferred is formed on the photoreceptor, an image formation is performed after cleaning is done a plurality of times for an area on which the above-mentioned toner image has been formed in the previous process.

(2) An image forming apparatus as set forth in the structure (1), wherein the volume average particle size of the toner is 3 to 7 $\mu$m.

(3) An image forming apparatus using a toner having a volume average particle size of 2 to 8 $\mu$m, comprising a charging device for uniformly charging a photoreceptor, a developing device for developing an image obtained by image exposure by said toner, a transfer device for transferring a toner image to a transfer material, a fixing device for fixing, and a cleaning device for cleaning the photoreceptor after the transfer of a toner image, and carrying out image formation by using repeatedly the photoreceptor after cleaning, wherein it is employed a mechanism such that, in the case where a toner image which is not to be transferred is formed on the photoreceptor, image formation is performed in such a way that the image does not overlap the area on which the above-mentioned toner image has been formed in the previous process.

(4) An image forming apparatus as set forth in the structure (3), wherein the volume average particle size of the toner is 3 to 7 $\mu$m.

(5) An image forming apparatus using a toner containing toner particles having a coefficient of shape falling within a range of 1.0 to 1.6 of an amount of at least 65% by number, comprising a charging device for uniformly charging a photoreceptor, a developing device for developing an image obtained by image exposure by said toner, a transfer device for transferring a toner image to a transfer material, a fixing device for fixing, and a cleaning device for cleaning the photoreceptor after the transfer of a toner image, and carrying out image formation by using repeatedly the photoreceptor after cleaning, wherein it is employed a mechanism such that, in the case where a toner image which is not to be transferred is formed on the photoreceptor, image formation is performed after cleaning is done a plurality of times for an area on which the above-mentioned toner image has been formed in the previous process.

The coefficient of shape mentioned above represents the ratio of an area of a circle with a diameter which is a projected maximum size of a toner particle to a projected area of the toner particle.

(6) An image forming apparatus as set forth in the structure (5), wherein a toner containing toner particles having the coefficient of shape falling within a range of 1.2 to 1.6 of an amount of at least 65% by number is used.

(7) An image forming apparatus using a toner containing toner particles having a coefficient of shape falling within a range of 1.0 to 1.6 of an amount of at least 65% by number, comprising a charging device for uniformly charging a photoreceptor, a developing device for developing an image obtained by image exposure by said toner, a transfer device for transferring a toner image to a transfer material, a fixing device for fixing, and a cleaning device for cleaning the photoreceptor after the transfer of a toner image, and using the photoreceptor after cleaning repeatedly to form an image, wherein it is employed a mechanism such that, in the case where a toner image which is not to be transferred is formed on the photoreceptor, image formation is performed in such a way that the image does not overlap the area on which the above-mentioned toner image has been formed in the previous process.

(8) An image forming apparatus as set forth in the structure (7), wherein a toner containing toner particles having the coefficient of particle shape of 1.2 to 1.6 at least 65% by number is used.

(9) An image forming apparatus using a toner containing toner particles having no protrusion of an amount of at least 50% by number, comprising a charging device for uniformly charging a photoreceptor, a developing device for developing an image obtained by image exposure by said toner, a transfer device for transferring a toner image to a transfer material, a fixing device for fixing, and a cleaning device for cleaning the photoreceptor after the transfer of a toner image, and using the photoreceptor after cleaning repeatedly to form an image, wherein it is employed a mechanism such that, in the case where a toner image which is not to be transferred is formed on the photoreceptor, image formation is performed after cleaning is done a plurality of times for an area on which the above-mentioned toner image has been formed in the previous process.

(10) An image forming apparatus using a toner containing toner particles having no protrusion of an amount of at least 50% by number, comprising a charging device for uniformly charging a photoreceptor, a developing device for developing an image obtained by image exposure by said toner, a transfer device for transferring a toner image to a transfer material, a fixing device for fixing, and a cleaning device for cleaning the photoreceptor after the transfer of a toner image, and using the photoreceptor after cleaning repeatedly to form an image, wherein it is employed a mechanism such that, in the case where a toner image which is not to be transferred is formed on the photoreceptor, image formation is performed in such a way that the image does not overlap the area on which the above-mentioned toner image has been formed in the previous process.

(11) An image forming apparatus as set forth in any one of the structures (1) to (10), wherein the aforesaid toner image which is not to be transferred is a patch image for detecting image density, or a band-shaped image extending in the width direction of the photoreceptor formed on at least one of the leading edge portion and the trailing edge portion of the image area.

(12) An image forming method using a toner having a volume average particle size of 2 to 8 $\mu$m, and repeating a process comprising the steps of uniformly charging a photoreceptor, developing an image obtained by image exposure by said toner, transferring and fixing the obtained toner image onto a transfer material, and cleaning the photoreceptor after the toner image is transferred for reuse, wherein, in the case where a toner image which is not to be transferred is formed on the photoreceptor, image formation is performed after cleaning is done a plurality of times for an area of the photoreceptor on which the above-mentioned toner image has been previously formed.

(13) An image forming method as set forth in the structure (12), wherein the volume average particle size of the toner is 3 to 7 $\mu$m.

(14) An image forming method using a toner having a volume average particle size of 2 to 8 $\mu$m, and repeating a process comprising the steps of uniformly charging a photoreceptor, developing an image obtained by image exposure by said toner, transferring and fixing the obtained toner image onto a transfer material, and cleaning the photoreceptor after the toner image is transferred for reuse, wherein, in the case where a toner image which is not to be transferred is formed on the photoreceptor, an image formation is performed in such a way that the image does not overlap the area on the photoreceptor on which the above-mentioned toner image has been previously formed in the previous process.

(15) An image forming method as set forth in the structure (14), wherein the volume average particle size of the toner is 3 to 7 $\mu$m.

(16) An image forming method using a toner containing toner particles having a coefficient of particle shape falling within a range of 1.0 to 1.6 of an amount of at least 65% by number, and repeating a process comprising the steps of uniformly charging a photoreceptor, developing an image obtained by image exposure by said toner, transferring and fixing the obtained toner image onto a transfer material, and cleaning the photoreceptor after the toner image is transferred for reuse, wherein, in the case where a toner image which is not to be transferred is formed on the photoreceptor, image formation is performed after cleaning is done a plurality of times for an area of the photoreceptor on which the above-mentioned toner image has been previously formed.

(17) An image forming method as set forth in the structure (16), wherein a toner containing toner particles having the coefficient of shape falling within a range of 1.2 to 1.6 of an amount of at least 65% by number is used.

(18) An image forming method using a toner containing toner particles having a coefficient of shape falling within a range of 1.0 to 1.6 of an amount of at least 65% by number, and repeating a process comprising the steps of uniformly charging a photoreceptor, developing an image obtained by image exposure by said toner, transferring and fixing the obtained toner image onto a transfer material, and cleaning the photoreceptor after the toner image is transferred for reuse, wherein, in the case where a toner image which is not to be transferred is formed on the photoreceptor, image formation is performed in such a way that the image does not overlap the area on the photoreceptor on which the above-mentioned toner image has been previously formed in the previous process.

(19) An image forming method as set forth in the structure (18), wherein a toner containing toner particles having the coefficient of shape falling within a range of 1.2 to 1.6 of an amount of at least 65% by number is used.

(20) An image forming method using a toner containing toner particles having no protrusion of an amount of at least 50% by number, and repeating a process comprising the steps of uniformly charging a photoreceptor, developing an image obtained by image exposure by said toner, transferring and fixing the obtained toner image onto a transfer material, and cleaning the photoreceptor after the toner image is transferred for reuse, wherein, in the case where a toner image which is not to be transferred is formed on the photoreceptor, image formation is performed after cleaning is done a plurality of times for an area of the photoreceptor on which the above-mentioned toner image has been previously formed.

(21) An image forming method using a toner containing toner particles having no protrusion of an amount of at least 50% by number, and repeating a process comprising the steps of uniformly charging a photoreceptor, developing an image obtained by image exposure by said toner, transferring and fixing the obtained toner image onto a transfer material, and cleaning the photoreceptor after the toner image is transferred for reuse, wherein, in the case where a toner image which is not to be transferred is formed on the photoreceptor, image formation is performed in such a way that the image does not overlap the area on the photoreceptor on which the above-mentioned toner image has been previously formed in the previous process.

(22) An image forming method as set forth in any one of the structures (12) to (21), wherein the aforesaid toner image which is not to be transferred is a patch image for detecting image density, or a band-shaped image extending in the width direction of the photoreceptor formed on at least one of the leading edge portion and the trailing edge portion of the image area.

This invention is such one as to provide an image forming apparatus, while using a toner having a small particle diameter or a toner whose surface shape has no remarkable concave or convex portions, and incorporating a countermeasure against poor cleaning owing to patch image formation for detecting image density or formation of band-shaped images extending over the whole width of the photoreceptor at specified intervals, capable of preventing problems which are newly produced therein beforehand, and accomplishing a high-speed and high-quality image formation stably over a long period of time.

Besides, in the explanation of this invention, its aspects are sometimes called in the following way.

First aspect: the aspect having the structure set forth in any one of the structures (1) to (4), and (12) to (15);

Second aspect: the aspect having the structure set forth in any one of the structures (5) to (8), and (16) to (19); and Third aspect: the aspect having the structure set forth in any one of the structures (9) and (10), and (20) and (21).

DETAILED DESCRIPTION OF THE PREFERRED EMBODIMENT

In the following, the constituent factors and examples of the embodiment of this invention will be explained more concretely.

(Image Forming Apparatus)

An example of an image forming apparatus of this invention will be explained.

Figure 1:
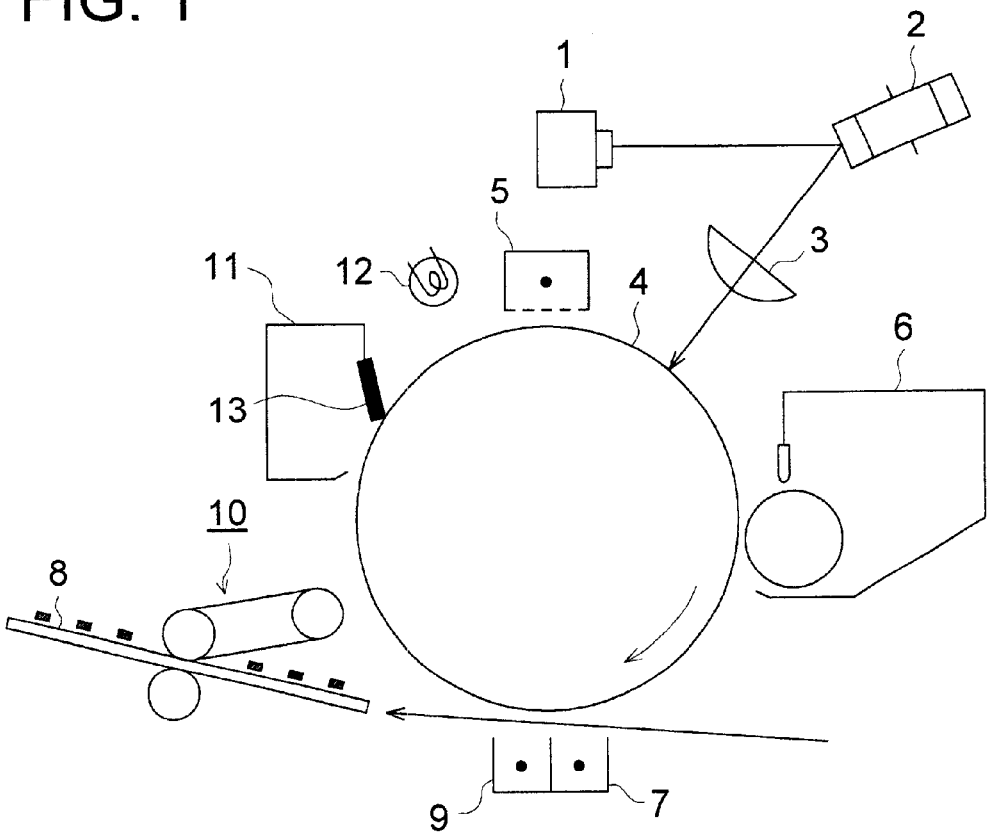
FIG. 1 is an outline structural drawing of an image forming apparatus showing an example of the embodiment of this invention.

FIG. 1 is an outline structural drawing of an image forming apparatus showing an example of the embodiment of this invention. Numeral 4 denotes a photoreceptor drum, is composed of an organic photoconductor (OPC) as a photoreceptor layer formed on the outer circumferential surface of a drum base made of aluminum, and rotates at a specified speed in the direction of the arrow mark. In this example of the embodiment, the photoreceptor drum 4 has an outer diameter of 60 mm.

In FIG. 1, on the basis of information read by a document reading apparatus (not shown in the drawing), an exposure light beam is emitted from a semiconductor laser light source 1. This is deflected by a polygonal mirror 2 in the direction perpendicular to the paper surface in FIG. 1, and is applied to the surface of the photoreceptor through an fθ lens 3 for correcting image distortion, to form an electrostatic latent image. The photoreceptor is uniformly charged by a scorotron charging device 5 beforehand, and is started to rotate in the clockwise direction in synchronism with the timing of the image exposure.

The electrostatic latent image on the photoreceptor drum surface is developed by a toner in a developing device 6, and the developed image formed is transferred to a transfer material 8, which has been conveyed with its timing adjusted, by the action of a transfer device 7. Further, the transfer material 8 is separated from the photoreceptor drum 4 by a separation device (separation electrode) 9, and the toner image transferred to the transfer material 8 is carried by it and introduced to a fixing device 10, where it is fixed.

After the non-transferred residual toner particles remaining on the photoreceptor surface are removed by a cleaning blade 13 in a cleaning device 11, the remaining charge is eliminated by pre-charging exposure (PCL) 12, and the photoreceptor is charged uniformly again by the scorotron charging device 5 for the next image formation. Subsequently, after image exposure is made, new development is carried out by the developing device 6.

In addition, the transfer material is representatively a sheet of plain paper, but it is not limited to a particular one and a material of any kind may be used, including a PET (polyethyleneterephthalate) sheet for an OHP of course, so long as an unfixed toner image after development can be transferred onto it. Further, also it is appropriate a method not to transfer a toner image directly onto a transfer material but to transfer it onto a transfer material after once transferring it onto an intermediate transfer member.

For a scanning optical system to carry out light modification by a digital signal from a computer employed in this image forming method and apparatus or an original document for copying, (1) a device for carrying out light modification by means of an acousto-optic device which is provided in a laser optical system, and (2) a device using a semiconductor laser and directly modifying the laser beam intensity can be cited. By a spot exposure to a light beam from any one of these scanning optical system on the uniformly charged photoreceptor surface, an image composed of dots is formed. In this case, because what is called a reverse development method, in which the exposed area is developed, is advantageous, usually development is done by a reverse development method.

The light beam emitted from the above-mentioned scanning optical system has a circular or elliptical cross-section and a brightness distribution approximately equal to a normal distribution with its base broadened in the left-to-right direction, and for example, in the case of a laser beam, the cross-section has a very small circular or elliptical shape with one or both of its axes in the main scanning direction and sub-scanning direction ranging from 20 to 100 $\mu$m.

To show an example of the fixing condition by the fixing device of this invention, the fixing temperature (the surface temperature of the heating roller) is 150 to 210° C., and the linear speed of fixing is 80 to 640 mm/sec.

Besides, it is needless to say that the scorotron charging device 5 is an example of the "uniform charging means" in this invention, the semiconductor laser light source 1, the polygonal mirror 2, the fθ lens 3, and the developing device 6 are an example of the "means for making imagewise exposure and toner development", the transfer device 7, the separation device (separation electrode) 9, and the fixing device 10 are an example of the "means for transferring and fixing a toner image onto a transfer material", and the cleaning device 11 is an example of the "means for cleaning the photoreceptor after transferring a toner image" of this invention.

Figure 2:
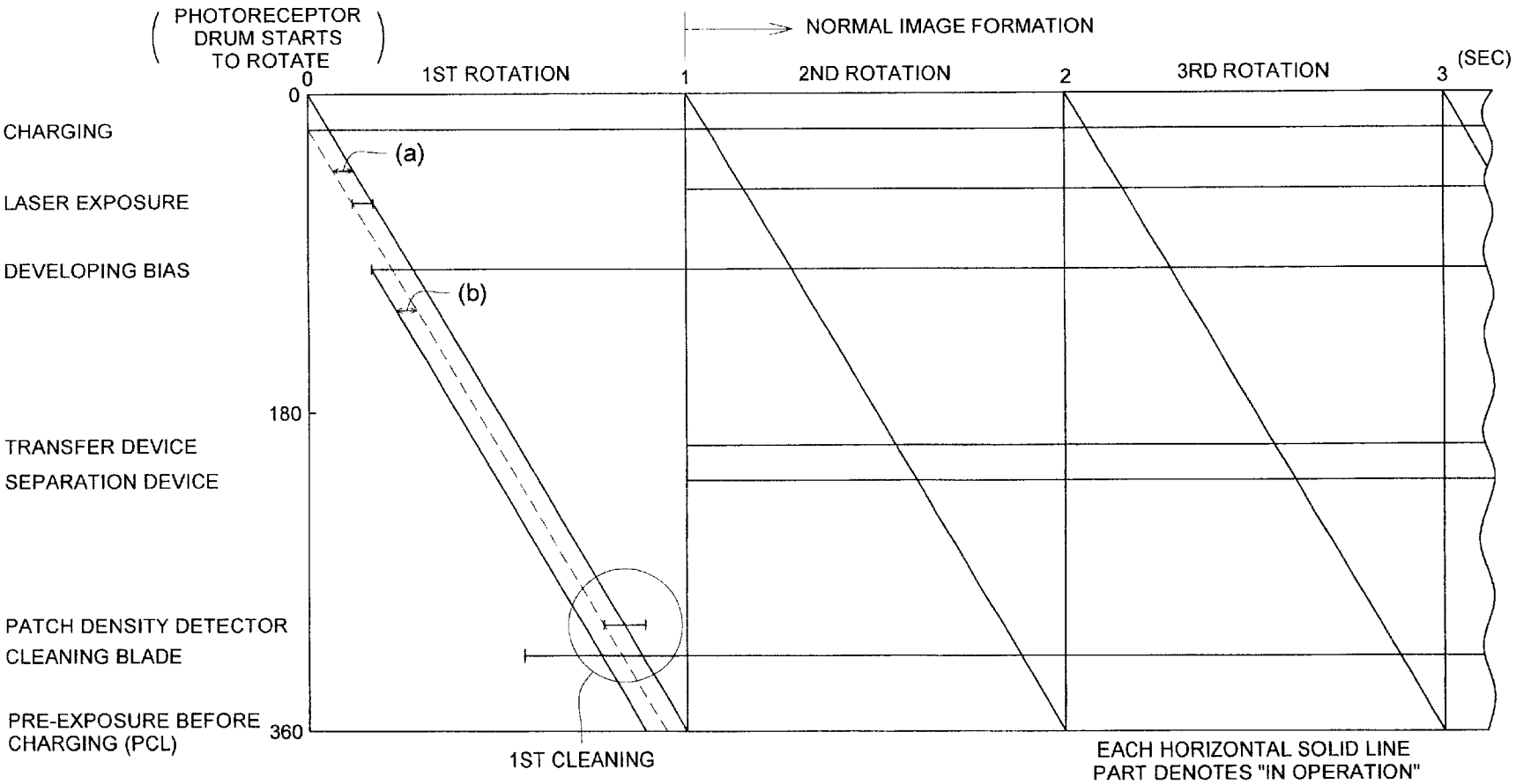
FIG. 2 PRIOR ART
FIG. 2 is a time chart of a sequence control for a conventional image forming process.

The image forming process is as described in the above, and the time chart of sequence control has heretofore been such as shown in FIG. 2.

On the ordinate of FIG. 2, the rotational angle of the photoreceptor drum is indicated with the pre-charging exposure (PCL) taken as the reference point (0°), and the each of the devices which are arranged around the photoreceptor drum is noted at the pertinent angular position.

The abscissa represents the passage of time, and in this drawing, it is indicated on the premise that the photoreceptor drum makes one rotation per second for the ease of understanding.

When the photoreceptor drum starts to rotate and also the charging device starts to act at the same time, an area on which an image can be formed is provided in front of the proper image formation area as shown by (a). As regards the patch for detecting image density, a patch latent image is formed in this area by laser beam exposure, and the toner image is formed when it reaches the developing device. This toner image is not transferred by the transfer device and passes the separation device zone; then, it gives the information for controlling the toner concentration in the developer on the basis of the result of detection by a density detector.

After one rotation of the photoreceptor drum, the sequence control is practiced in accordance with the proper image formation process from its second rotation. In this case, as regards the area where a patch toner image is formed, after it is cleaned by the cleaning device positioned next, it is used for a normal image formation. However, as regards the non-transferred toner image using a toner of this invention, which has been developed up to the maximum density, because it is difficult to eliminate the toner particles completely by a single cleaning process, this part of the photoreceptor is used in image formation as it is not cleaned completely still holding residual toner particles. In another way, if it is cleaned forcibly, for example, with the pressing force of the cleaning blade strengthened, the surface of the photoreceptor gets damaged, for example.

Figure 3:
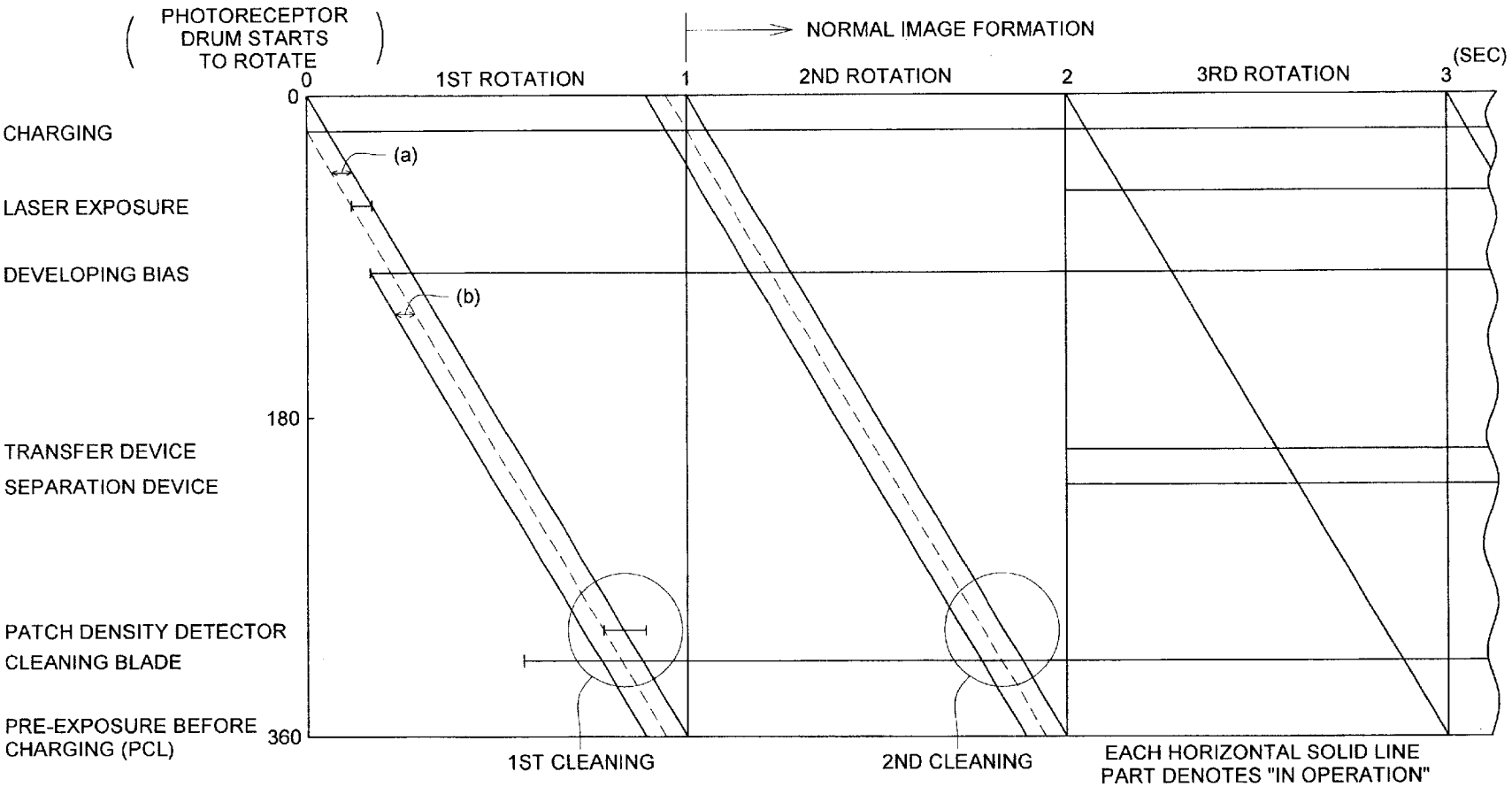
FIG. 3 is a time chart of a sequence control for an image forming process of this invention.

In this invention, as shown in FIG. 3, this problem has been solved by varying the sequence control in such a way as to carry out cleaning a plurality of times (twice), and practicing a sufficient cleaning process. Even if a toner having a small particle diameter, a uniform shape, or no protrusion as a toner of this invention is used, and a patch image density detection method is employed, cleaning can be performed not forcibly.

Further, in order to perform cleaning uniformly, even in forming a uniform toner image over the whole width of the photoreceptor surface (hence, supply of a smoothing agent can be done too), similar method can be employed. In this case, band-shaped images are formed over the whole width of the photoreceptor; for this purpose, a developing bias voltage is applied to areas (2) where charging device is not turned on. Because an uncharged area is developed in reverse development, a band-shaped image extending over the whole width of the photoreceptor is formed on this area.

Also this toner image has the maximum image density or an image density near to it; therefore, if it is not processed in the same way as a patch image, it produces a problem owing to poor cleaning. Hence, as shown in FIG. 3, it is necessary to practice cleaning a plurality of times before starting the proper image formation.

If it is not desired to rotate the photoreceptor drum twice before image formation, it is appropriate to employ a method in which two cleaning devices are mounted. In this case, also it is appropriate to use a device of a different cleaning method such as, for example, a cleaning brush for one of them.

Further, in the above-mentioned FIG. 1, a monochromatic image forming apparatus is explained, this invention can be applied to also a multi-color image forming apparatus in which an intermediate transferring body is used.

Further, if the sequence control shown in the above-mentioned FIG. 2 and FIG. 3 is continued, because a patch image or band-shaped images over the whole width are formed repeatedly at the same position of the photoreceptor, a problem is produced even if cleaning is carried out a plurality of times. Hence, so as to vary the position, it is appropriate to rotate the photoreceptor drum through a certain angle before or after image formation. By doing this way, it is possible to keep the photoreceptor surface uniform.

In the following, a toner of this invention will be explained.

As regards a method of producing a toner of this invention, there is no particular limitation. However, it will be desirably employed a method to use resin particles obtained by fusing and bonding fine resin particles to one another, which are prepared by an emulsion polymerization method, a suspension polymerization method, or the like, or resin particles prepared by a suspension polymerization method, in an aqueous medium. As regards these resin particles, because their surfaces are formed in a solution with a solvent such as an aqueous medium, they have the advantage that their surfaces are uniform. Further, because resin particles prepared by a suspension polymerization method are spherical, toner particles have a smooth surface shape. Resin particles obtained by fusing and bonding fine resin particles to one another have a sharper particle diameter distribution as compared to resin particles obtained by suspension polymerization, and are more desirably used.

In the following, an example of the material and the manufacturing method of a toner of this invention will be described.

(Material)

(Monomer):

As regards the polymerizable monomer, radical-polymerizable monomer is an essential component and a bridging agent is added as occasion demands. Besides, in addition to these, also it is appropriate to contain at least one kind of a radical-polymerizable monomer having an acidic radical or a radical-polymerizable monomer having a basic radical.

(1) the radical-polymerizable monomer:

As regards the radical-polymerizable monomer, there is no particular limitation, and any one of radical-polymerizable monomers known to public can be used. Further, it is possible to use a combination of two or more kinds of them so as to make the resin have required properties.

To state it concretely, an aromatic vinyl monomer, a (meth)acrylic ester monomer, a vinyl ester monomer, vinylether monomer, a mono-olefin monomer, a di-olefin monomer, an olefin halide monomer, etc. can be used.

For the aromatic vinyl monomer, for example, styrene monomers such as styrene, o-methylstyrene, m-methylstyrene, p-methylstyrene, p-methoxystyrene, p-phenylstyrene, p-chlorostyrene, p-ethylstyrene, p-n-butylstyrene, p-tert-butylstyrene, p-n-hexylstyrene, p-n-octylstyrene, p-n-nonylstyrene, p-n-decylstyrene, p-n-dodecylstyrene, 2,4-dimethylstyrene, and 3,4-dichlorostyrene, and derivatives of them can be cited.

For the (meth)acrylic ester monomer, methyl acrylate, ethyl acrylate, butyl acrylate, 2-ethylhexyl acrylate, cyclohexyl acrylate, phenyl acrylate, methyl methacrylate, ethyl methacrylate, butyl methacrylate, hexyl methacrylate, 2-ethylhexyl methacrylate, ethyl β-hydroxyacrylate, propyl γ-aminoacrylate, stearyl methacrylate, dimethylaminoethyl methacrylate, diethylaminoethyl methacrylate, etc. can be cited.

For the vinyl ester monomer, vinyl acetate, vinyl propionate, vinyl benzoate, etc. can be cited.

For the vinylether monomer, vinylmethyl ether, vinylethyl ether, vinylisobutyl ether, vinylphenyl ether, etc, can be cited.

For the mono-olefin monomer, ethylene, propylene, isobutylene, 1-butene, 1-pentene, 4-methyl-1-pentene, etc. can be cited.

For the di-olefin monomer, butadiene, isoprene, chloroprene, etc. can be cited.

For the olefin halide monomer, vinyl chloride, vinylidene chloride, vinyl bromide, etc. can be cited.

(2) bridging agent:

For a bridging agent to be added for the purpose of improving the properties of a toner, a radical-polymerizable bridging agent is used. For the radical-polymerizable bridging agent, one that has two or more unsaturated bonds such as divinyl benzene, divinyl naphthalene, divinyl ether, diethyleneglycol methacrylate, ethyleneglycol dimethacrylate, polyethyleneglycol dimethacrylate, diaryl phthalate, etc. can be cited.

As regards the radical-polymerizable bridging agent, it is desirable to use them within a range of 0.1 to 10% by weight to the total radical-polymerizable monomer, although it depends on the property.

(3) the radical-polymerizable monomer having an acidic radical or the radical-polymerizable monomer having a basic radical:

For the radical-polymerizable monomer having an acidic radical or the radical-polymerizable monomer having a basic radical, for example, a monomer containing a carboxyl radical, a monomer containing a sulfonic radical, and amine compounds such as primary amine, secondary amine, tertiary amine, and a quaternary ammonium salt can be used.

For the radical-polymerizable monomer having an acidic radical, for example, a monomer containing a carboxyl radical, a monomer containing a sulfonic radical, etc. can be used. For the monomer containing a carboxyl radical, acrylic acid, methacrylic acid, fumaric acid, maleic acid, itaconic acid, cinnamic acid, maleic mono-butyl ester, maleic mono-octyl ester, etc. can be cited. For the monomer containing a sulfonic radical, styrene sulfonate, arylsulfosuccinic acid, octyl arylsulfosuccinate, etc. can be cited. It is appropriate that these have a structure of a salt of an alkaline metal such as sodium or potassium or of an alkaline earth metal such as calcium.

For the radical-polymerizable monomer having a basic radical, for example, amine compounds such as primary amine, secondary amine, tertiary amine, and a quaternary ammonium salt can be used. To state it concretely, dimethylaminoethyl acrylate, dimethylaminoethyl methacrylate, diethylaminoethyl acrylate, diethylaminoethyl methacrylate, a quaternary ammonium salt of these four kinds of compounds, 3-dimethylaminophenyl acrylate, a 2-hydroxy-3-methacryloxypropyltrimethyl ammonium salt, acryl amide N-butylacryl amide, N,N-dibutylacryl amide, piperidylacryl amide, methacryl amide, N-butylmethacryl amide, N-octadecylacryl amide, vinyl pyridine, vinyl pyrrolidone, vinyl N-methylpyridinium chloride, vinyl N-ethylpyridinium chloride, N,N-diarylmethyl ammonium chloride, N,N-diarylethyl ammonium chloride, etc. can be cited.

It is desirable that the radical-polymerizable monomer having an acidic radical or the radical-polymerizable monomer having a basic radical is used within a range of 0.1 to 15% by weight to the total radical-polymerizable monomer.

(Chain-Transfer Agent)

For the purpose of adjusting the molecular weight, it is possible to use a chain-transfer agent which is generally used. As regards the chain-transfer agent, there is no particular limitation, and for example, mercaptans such as octylmercaptan, dodecylmercaptan, and tert-dodecylmercaptan, and a styrene dimer are used.

(Polimerization Initiator, Dispersion Stabilizer, Surface Active Agent):

In the case where, after fine resin particles are prepared by what is called an emulsion polymerization method, the fine resin particles are salted out and fused to be bonded to one another to form resin particles as toner particles, a water soluble radical polymerization initiator is used. For the water soluble radical polymerization initiator, for example, persulfate salts (potassium persulfate, ammonium persulfate, etc.), azo compounds (4,4'-azobis-4-cyanovaleric acid and its salt, 2,2'-azobis(2-amidinopropane) salt, etc.), peroxide compounds, etc. can be cited. It is possible to make these radical polymerization initiator a redox initiator by combining it with a reduction agent as occasion demands. By using a redox initiator, polymerization activity is improved which makes the polymerization temperature lowered, and further, the shortening of polymerization time can be expected.

The quantity of the polymerization initiator to be added is determined by the molecular weight of the resin to become a final toner, and it is generally 0.1 to 10% by weight to the radical polymerizable monomer, and desirably 0.2 to 5% by weight. Further, as regards the polymerization temperature, it is possible to select any temperature so long as it is not lower than the lowest radical generation temperature of the polymerization initiator; for example, a temperature falling within a range of 50° C. to 90° C. is used. However, by using a polymerization initiator starting at normal temperature, for example, a combination of hydrogen peroxide with a reducing agent (ascorbic acid, etc.), it becomes possible to make polymerization at room temperature or at a temperature a little higher than it.

As regards the surface active agent which can be used in emulsion polymerization, there is no particular limitation; however, because it is necessary to disperse the above-mentioned radical-polymerizable monomer as oil drops in an aqueous medium, an ionic surfactant can be cited as an example of suitable one. For the ionic surfactant, salts of sulfonic acids (sodium dodecylbenzenesulfonate, sodium arylalkylpolyethersulfonate, sodium 3,3-disulfonicdiphenylurea-4,4-diazo-bis-amino-8-naphthol-6-sulfonate, ortho-carboxibenzene-azo-dimethylaniline, sodium 2,2,5,5-tetramethyl-triphenylmethane-4,4-diazo-bis-β-naphthol-6-sulfonate, etc.), salts of sulfuric ester (sodium dodecylsulfate, sodium tetradecylsulfate, sodium pentadecylsulfate, sodium octylsulfate, etc.), salts of fatty acid (sodium oleate, sodium laurate, sodium caprate, sodium caprylate, sodium capronate, potassium stearate, calcium oleate, etc.), etc. can be cited. Further, in addition to the above, a nonionic surface active agent can be used. To state it concretely, polyethylene oxide, polypropylene oxide, a combination of polypropylene oxide and polyethylene oxide, ester of polyethylene glycol and higher fatty acid, alkylphenolpolyethylene oxide, ester of higher fatty acid and polyethylene glycol, ester of higher fatty acid and polypropyrene oxide, sorbitan ester, etc. can be cited.

Further, these surface active agents are used mainly at the time of emulsion polymerization, but they may be used in some other processes or for other purposes.

In the case where resin particles as the parent particles of a toner is manufactured by what is called a suspension polymerization method, or in the case where resin particles prepared by a suspension polymerization method are salted out and fused to be bonded to one another to form resin particles as the parent particles of a toner, it is desirable to use an oil soluble radical polymerization initiator. For the oil soluble radical polymerization initiator, to state it concretely, peroxides such as benzoyl peroxide, lauroyl peroxide, cumene hydroperoxide, t-butylhydroperoxide, dicumyl peroxide, acetyl peroxide, and propionyl peroxide, azobis polymerization initiators such as 2,2'-azobisisobutylonitrile, 2,2'-azobis(2,4-valeronitrile), 2,2'-azobis-2-methylvaleronitrile, and 2,2'-azobis-2,4-dimethylvaleronitrile, etc. can be cited. The quantity of polymerization initiator to be added is determined by the molecular weight of the resin to become a toner finally; it is generally 0.1 to 10% by weight to the radical-polymerizable monomer, and desirably 0.2 to 5% by weight.

In a suspension polymerization method, a dispersion stabilizing agent is used as being dispersed in an aqueous medium. For the dispersion stabilizing agent, it is desirable such one that can be easily removed finally at the stage of filtration and washing, and in particular, an hardly water soluble inorganic dispersion stabilizing agent is desirably used. To state it concretely, calcium carbonate, calcium tertiary phosphate, aluminum oxide, barium carbonate, magnesium carbonate, barium sulfate, aluminum hydroxide, titanium oxide, silicon oxide, iron hydroxide, etc. can be cited, and a particularly desirable dispersion stabilizing agent is calcium tertiary phosphate. Besides, also it is appropriate to use a little amount of surface active agent as a dispersion assisting agent in addition to this hardly water soluble inorganic dispersion stabilizing agent. In this case, any one of nonionic, anionic, cationic, ampholytic surface active agents can be used, but desirable one is an anionic surface active agent.

As regards the dispersion stabilizing agent, it is desirable to use it of a quantity of about 1 to 10% by weight to the oil phase component to be dispersed. If it is less than this range, the stability of dispersion is lowered and flocculation of particles occurs, and if it is more than this range, dispersion is promoted to produce too excessive smaller diameter components. Further, it is desirable that the surface active agent is added with an amount of 0.05 to 1% by weight to the inorganic dispersion stabilizing agent. If it is less than this range, it cannot exhibit the effect of improving dispersion stabilization, and if it is used with an amount exceeding this range, it is posed a problem that emulsification of radical-polymerizable monomer occurs, and so called latex particles are produced in the system, while there is also a problem that the removal of the surface active agent is difficult to do to cause the adsorption of water to occur.

(Coloring Agent)

For a coloring agent, any one of inorganic pigments, organic pigments, and dyes known to public can be used.

To state concrete examples of the inorganic pigments, as regards black pigments, for example, carbon blacks such as furnace black, channel black, acetylene black, thermal black, lampblack, etc. can be used, and magnetic particles of magnetite, ferrite, etc. can be used.

To state concrete examples of the organic pigments, for magenta or red pigments, for example, C. I. pigment-red 3, C. I. pigment-red 5, C. I. pigment-red 6, C. I. pigment-red 7, C. I. pigment-red 15, C. I. pigment-red 16, C. I. pigment-red 48:1, C. I. pigment-red 53:1, C. I. pigment-red 57:1, C. I. pigment-red 122, C. I. pigment-red 123, C. I. pigment-red 139, C. I. pigment-red 144, C. I. pigment-red 149, C. I. pigment-red 166, C. I. pigment-red 177, C. I. pigment-red 178, C. I. pigment-red 222, etc. can be cited.

Further, for orange or yellow pigments, C. I. pigment-orange 31, C. I. pigment-orange 43, C. I. pigment-yellow 12, C. I. pigment-yellow 13, C. I. pigment-yellow 14, C. I. pigment-yellow 15, C. I. pigment-yellow 17, C. I. pigment-yellow 93, C. I. pigment-yellow 94, C. I. pigment-yellow 138, etc. can be cited.

For green or cyan pigments, C. I. pigment-blue 15, C. I. pigment-blue 15:2, C. I. pigment-blue 15:3, C. I. pigment-blue 16, C. I. pigment-blue 60, C. I. pigment-green 7, etc. can be cited.

To state concrete examples of dyes, C. I. solvent-red 1, C. I. solvent-red 49, C. I. solvent-red 52, C. I. solvent-red 58, C. I. solvent-red 63, C. I. solvent-red 111, C. I. solvent-red 122, C. I. solvent-yellow 19, C. I. solvent-yellow 44, C. I. solvent-yellow 77, C. I. solvent-yellow 79, C. I. solvent-yellow 81, C. I. solvent-yellow 82, C. I. solvent-yellow 93, C. I. solvent-yellow 98, C. I. solvent-yellow 103, C. I. solvent-yellow 104, C. I. solvent-yellow 112, C. I. solvent-yellow 162, C. I. solvent-blue 25, C. I. solvent-blue 36, solvent-blue 60, C. I. solvent-blue 70, solvent-blue 93, C. I. solvent-blue 95, etc. can be cited.

As regards these inorganic pigments, organic pigments, and dyes, it is possible to select one or a plurality of them together for use in response to a request. Further, the quantity of a pigment to be added is 2 to 20% by weight to the polymer, and desirably, 3 to 15% by weight is selected. In the case where the toner is used as a magnetic toner, usually the above-mentioned magnetite is added; in this case, from the viewpoint of giving the specified magnetic properties, it is desirable to add an amount of 20 to 60% by weight in the toner.

It is also possible to use a coloring agent with its surface reformed. For the surface reforming agent, any one known to public can be used; to state it concretely, a silane coupling agent, a titanium coupling agent, an aluminum coupling agent, etc. can be desirably used.

(Other Internal Additives):

It is possible to add a constituent other than a coloring agent such as a releasing agent or a charge controlling agent. For the releasing agent, various kinds of ones known to public can be used, for example, olefin wax such as low molecular weight polypropylene or polyethylene, and a modification of these, natural wax such as carnauba wax, or hydrogenated rice wax, amide wax such as fatty acid bisamide, etc. can be cited. In the same way, as regards the charge controlling agent too, various kinds of ones known to public can be used; for example, a Nigrosine dye, a metal salt of naphthenic acid, or higher fatty acid, alkoxyamine, a quaternary ammonium salt compound, azo metallic complex, a metallic salt of salicilic acid or its metallic complex, etc. can be cited. It is desirable to make the particles of these releasing agent and charge controlling agent have a number-average primary particle diameter of about 10 to 500 nm.

(External Additives):

It is possible to use what is called an external additive to be added in a toner of this invention for the purpose of improving fluidity or raising the cleaning performance. As regards this external additive, there is no particular limitation, and various kinds of inorganic fine particles, organic fine particles, and a smoothing agent can be used.

For the inorganic fine particles, those of any kind known to public can be used. To state it concretely, fine particles of silica, titania, aluminum, etc. can be desirably used. For these fine particles, hydrophobic ones are desirable. To state it concretely, as for the silica fine particles, for example, products on the market produced by Nihon Aerosil Co., Ltd. R-805, R-976, R-974, R-972, R-812, and R-809, products produced by Hoechst GmbH HVK-2150 and H-200, products on the market produced by Cabot Corp. TS-720, TS-530, TS-610, H-5, and MS-5, etc. can be cited. For the titania fine particles, for example, products on the market produced by Nihon Aerosil Co., Ltd. T-805 and T-604, products on the market produced by TAYCA Corp. MT-100S, MT-100B, MT-500BS, MT-600, MT-600SS, and JA-1, products on the market produced by Fuji Titanium Industry Corp. TA-300SI, TA-500, TAF-130, TAF-510, and TAF-510T, products on the market produced by Idemitsu Kosan Co., Ltd. IT-S, IT-OA, IT-OB, and IT-OC, etc. can be cited. For the alumina fine particles, for example, products on the market produced by Nihon Aerosil Co., Ltd. RFY-C and C-604, a product on the market produced by Ishihara Sangyo Kaisha, Ltd. TO-55, etc. can be cited.

It is desirable that these inorganic fine particles are treated for making them hydrophobic by a silane coupling agent, a titanium coupling agent, or the like. For the degree of the treatment for making hydrophobic, there is no particular limitation, but it is desirable that the degree of making hydrophobic expressed by methanol wettability is 40 to 95. Methanol wettability is a measure for evaluating the wettability to methanol, that is, 50 ml of distilled water and 2.5 g of the inorganic fine particles to be measured are contained in a beaker having a capacity of 200 ml, and slowly stirred; then, by using a burette whose end portion is dipped in the liquid, methanol is dropped until the whole inorganic fine particles are wetted. With the methanol quantity required for completely wetting the inorganic fine particles at this time denoted by a (ml), the degree of making hydrophobic is calculated from the following equation, $$\text{Equation: degree of making hydrophobic}=(a/(a+50))\times 100.$$

For the organic fine particles, it is possible to use spherical organic fine particles having a number-average primary particle diameter of about 10 to 2000 nm. To state it concretely, fine particles of a homopolymer of styrene, methyl methacrylate, etc. or a copolymer of these can be used.

As regards the smoothing agent, for example, metallic salts of higher fatty acids such as stearic acid salts of metals such as zinc, aluminum, copper, magnesium, and calcium, oleic acid salts of metals such as zinc, manganese, iron, copper, and magnesium, palmitic acid salts of metals such as zinc, copper, magnesium, and calcium, linoleic acid salts of metals such as zinc and calcium, and ricinoleic acid salts of metals such as zinc and calcium can be cited.

It is desirable that the quantity of these external additives to be added is about 0.01 to 5% by weight to the toner.

(Manufacturing Process)

(Manufacturing Process of Resin Particles):

For manufacturing resin particles as toner particles, it is desirably used a method in which resin particles prepared by a polymerization method based on emulsion polymerization, suspension polymerization, or the like are fused to be bonded to one another in an aqueous medium, or a method in which resin particles are produced by suspension polymerization.

The manufacturing process in the case where resin particles to become toner particles are manufactured by fusing and bonding resin particles to one another, which are prepared by a polymerization method based on emulsion polymerization, suspension polymerization, or the like, is composed of a polymerization process for preparing fine resin particles by a polymerization method based on emulsion polymerization, suspension polymerization, or the like, a process for fusing and bonding fine resin particles to one another in an aqueous medium using the dispersion liquid of the obtained fine resin particles, and a washing process for removing the surface active agent etc. by filtering out the obtained particles from the aqueous medium.

In the above description, the aqueous medium means one that is mainly composed of water, whose content is not less than 50% by weight. For a medium other than water, an organic solvent which is soluble in water can be cited; for example, methanol, ethanol, isopropanol, butanol, acetone, methylethylketone, tetrahydrofuran, etc. can be cited. It is desirable alcoholic organic solvent such as methanol, ethanol, isopropanol, or butanol which is an organic solvent not solving resin.

In the resin particle as the parent body of a toner particle, a coloring agent, a releasing agent, a charge controlling agent, etc. are contained as constituents as occasion demands. As regards these constituents of a toner, it is appropriate to employ any one of a method in which they are contained in the fine resin particles in the polymerization process for preparing the fine resin particles, and a method in which they are made to be contained in the resin particles by it that, after fine resin particles not containing these constituents of a toner are prepared, liquid in which the coloring agent, releasing agent, charge controlling agent, etc. are dispersed or dissolved is added to dispersion liquid of said fine resin particles, to fuse those fine resin particles to be bonded to one another; however, it is desirable that the releasing agent is made to be contained in the polymerization process, and the coloring agent is made to be contained in the process for fusing and bonding fine resin particles to one another.

For the polymerization process for preparing fine resin particles, it can be cited, for example, a method in which a solution composed of a releasing agent etc. dissolved in a polymerizable monomer is dispersed as oil drops by mechanical energy in an aqueous medium in which a surface active agent of not higher than the critical micelle concentration is dissolved, and a water soluble polymerization initiator is added to this dispersion liquid, to make radical polymerization. In this case, also it is appropriate to use an oil soluble polymerization initiator by adding it in the monomer. As regards a dispersion machine to practice this oil drop dispersion, there is no particular limitation; for example, a ClEARMIX, an ultrasonic dispersing machine, a mechanical homogenizer, a Mantongorlin, a pressure-type homogenizer, etc. can be cited.

For the method of fusing and bonding particles to one another, it is desirably used a method in which fine resin particles produced by a polymerization process and coloring agent particles are fused together to be bonded to one another while being salted out in an aqueous medium.

The process for practicing this salting out/fuse-bonding is a process in which salting out is made to proceed at the same time while fuse-bonding is carried out by it that a salting out agent composed of an alkaline metal salt, an alkaline earth metal salt, etc. is added as a flocculating agent of not lower than the critical flocculation concentration in water where the fine resin particles and the coloring agent particles are present, and subsequently, it is heated to a temperature not lower than the glass transition temperature of the fine resin particles. In this process, also it is possible to use a method to carry out the fuse-bonding effectively by adding an organic solvent which can be dissolved infinitely in water to lower substantially the glass transition temperature of the fine resin particles.

Now, to state concretely the alkaline metal salt and the alkaline earth metal salt as a salting out agent, for the alkaline metal, lithium, potassium, sodium, etc. can be cited, and for the alkaline earth metal, magnesium, calcium, strontium, barium, etc. can be cited; desirably, potassium, sodium, magnesium, calcium, and barium should be used. Further, for the constituent substance of the salts, a chloride salt, a bromide salt, an iodide salt, a carbonate salt, a sulfate salt, etc. can be cited. Besides, as regards the above-mentioned organic solvent which is infinitely dissolved in water, methanol, ethanol, 1-propanol, 2-propanol, ethyleneglycol, glycerin, acetone, etc. can be cited; among them, methanol, ethanol, 1-propanol, and 2-propanol, which are alcohol with three or less carbon atoms, are desirable, and especially, 2-propanol is desirable.

Further, the coloring agent particles are prepared by dispersing the coloring agent in an aqueous medium in which a surface active agent is contained with a concentration not lower than the critical micelle concentration (CMC). As regards the dispersing machine for dispersing the coloring agent, there is no particular limitation; desirably, pressure applying dispersion machines such as an ultrasonic dispersion machine, a mechanical homogenizer, a Mantongorlin, and a pressure-type homogenizer, and a medium-type dispersion machine such as a sand grinder, a Getzmann mill, and a diamond fine mill can be cited. Further, also it is possible to use coloring agent particles with their surface reformed; in this case, after a surface reforming agent is added in a dispersion liquid having coloring agent particles dispersed, the temperature is raised to carry out the reaction, and after the completion of the reaction, filtration, washing, and drying are carried out, to give pigment particles treated by the surface reforming agent.

In the case where fuse-bonding is carried out in a salting-out/fuse-bonding process, it is desirable to make the time to leave it as it is after the salting-out agent is added as short as possible. Although the reason for this is not definitely clear, the state of flocculation of the particles is varied depending on the time of leaving it as it is, which poses the problem that the particle diameter distribution becomes unstable, and the surface property of the resin particles fused and bonded together varies. Further, if the temperature at which the salting-out agent is added is not lower than the glass transition temperature of the fine resin particles, although the salting-out/fuse-bonding proceeds fast, the control of particle diameter cannot be done, which sometimes causes particles having a large diameter to be produced. For the range of this temperature of addition, a temperature not higher than the glass transition temperature is appropriate, and generally speaking, a range of 5 to 55° C., or desirably a range of 10 to 45° C. is appropriate.

After the salting-out agent is added at a temperature not higher than the glass transition temperature of the fine resin particles, it is desirable to employ a method in which the fine resin particles are heated to their glass transition temperature or higher by raising the temperature as fast as possible. As regards the temperature raising speed at this time, 1° C./min. or higher is desirable; the time to reach the target temperature is desirably shorter than thirty minutes, and the time shorter than ten minutes is especially desirable. The upper limit of the temperature raising speed is not particularly definite, but from the viewpoint of suppressing the generation of coarse big particles owing to a rapid progress of salting-out/fuse-bonding, a speed of 15° C./min. or slower is desirable. As an especially desirable mode of practice, if salting-out/fuse-bonding is continued to proceed even at the time when the temperature reaches or exceeds the glass transition temperature, fuse-bonding is made to effectively proceed together with the growth of the particles.

In the first aspect of this invention, the volume average particle size of the toner is 2 to 8 $\mu$m. Further, 3 to 7 $\mu$m is desirable. By making this, a high-resolution image can be stably obtained, and toner scattering and poor cleaning can be also prevented by taking a suitable countermeasure. Besides, a volume average particle size smaller than 2 $\mu$m is not practicable owing to toner scattering etc.

The volume average particle size of a toner (the same way for the resin particles) can be measured by means of a Coulter counter TA-II, Coulter multisizer, an SLAD1100 (manufactured by Shimazu Corp.: a particle diameter measuring apparatus of a laser diffraction type), etc., and in the case where a Coulter counter TA-II or a Coulter multisizer is used, it is shown a volume average particle size which is measured by using an aperture having a diameter of 100 $\mu$m and a particle diameter distribution falling within a range of 2.0 to 40 $\mu$m.

In the case where toner particles of this invention are formed by a polymerization method, the particle diameter can be controlled by the concentration of the flocculating agent, the addition quantity of the organic solvent, or the time of fuse-bonding, or further by the composition of the polymer itself in the manufacturing method of the toner described in detail in the foregoing.

In the second aspect of this invention, it is necessary that the proportion of the toner particles having a coefficient of shape falling within a range of 1.0 to 1.6 is made 65% by number or more, and it is desirable to make the proportion of the toner particles having a coefficient of shape falling within a range of 1.2 to 1.6 not less than 65% by number.

The coefficient of shape of a toner is expressed by the following equation, and represents the degree of roundness of a toner particle:

Equation: coefficient of shape $((\text{maximum diameter}/2)^2 \times \pi)/\text{projection area}$, where the maximum diameter means the maximum value of the width of a toner particle given by the distance between two parallel lines drawn in contact with a projection image of a toner particle put in between on a plane. Further, the projection area means the area of the projection image of a toner on a plane.

In this invention, this coefficient of shape was measured by practicing the analysis of a photographic image by means of a "SCANNING IMAGE ANALYZER" (manufactured by JEOL, Ltd.) on the basis of an enlarged photograph of a toner particle which was taken by a scanning electron microscope of 2000 magnifications. At this time, 100 toner particles were used, and the coefficient of shape of this invention was calculated on the basis of the above-mentioned equation.

By making the proportion of toner particles which have a value of this coefficient of shape falling within a range of 1.0 to 1.6 not less than 65% by number, the packing density of toner particles in a toner layer transferred onto a transfer material is made higher, which improves fixing performance and causes offset to become difficult to occur. Further, toner particles become hard to break, which reduces contamination of the charge giving member and stabilizes the charging property of the toner.

The method of controlling this coefficient of shape is not particularly limited. For example, there is a method in which it is adjusted by adding toner particles having a coefficient of shape falling within a range of 1.0 to 1.6 or 1.2 to 1.6, which are prepared by a method in which toner particles are jetted into a heated air flow, a method in which toner particles are repeatedly given a mechanical energy by an impact force in a gas phase, a method in which toner particles are added in a solvent which does not solve the toner particles to be involved in a whirling flow, or the like, in usual toner particles with an amount to make the toner be included in the scope of this invention. Further, there is a method in which it is adjusted by adding toner particles, whose coefficient of shape is adjusted to have a value falling within a range of 1.0 to 1.6 or 1.2 to 1.6 by controlling the shape of the whole in the stage of preparing the toner particles by what is called a polymerization method, in usual toner particles in the same way.

Among toners manufactured by any one of the above-mentioned manufacturing methods, a toner manufactured by a polymerization method is desirable for the reasons that the manufacturing method is simple, that the toner particles have an excellent surface uniformity as compared to toner particles produced by a pulverization method.

In order to control this coefficient of shape of a toner and the variation of the coefficient of shape to be extremely uniform without variation depending on the manufacturing lot, also it is appropriate to determine a proper process termination timing while the monitoring of the characteristics of toner particles (resin particles) in process of formation is carried out, in the process in which the resin particles (polymer particles) to become the constituent of the toner particles of this invention are prepared (polymerized), and said resin particles are fused to be bonded to one another to control the shape.

"Monitoring" means to practice a control of process conditions on the basis of the result of measurement by means of a measurement apparatus built in the production line. That is, the measurement of shape etc. is incorporated in the production line, for example in the case of toner particles produced by a polymerization method, which are formed by making resin particles cohere or fuse-bonded to one another in an aqueous medium, the shape and particle diameter are measured while sampling is successively practiced in the process of fuse-bonding, etc., and the reaction is stopped at the timing when the desired shape is obtained.

As regards the method of monitoring, there is no particular limitation; it is possible to use a flow-type particle image analyzing apparatus FPIA-2000 (manufactured by Toa Iyo Denshi Corp.). This apparatus is suitable because it can make monitoring by carrying out image processing in real time with the sample liquid made to pass. That is, monitoring is always carried out through taking sample liquid from the reaction field by using a pump or the like, to practice measurement of shape etc., and the reaction is stopped at the timing when the desired shape is obtained.

It is necessary that, in the toner particles composing the toner of the third aspect of this invention, the proportion of toner particles having no protrusion is not less than 50% by number, and it is desirable that this proportion is not less than 70% by number.

By making the proportion of the toner particles having no protrusion not less than 50% by number, toner particles which are easy to wear and break, and toner particles having a part to which electric charge is concentrated are reduced, charge quantity distribution becomes sharp, charging characteristic is stabilized, and an image having a good image quality can be formed over a long period of time.

Figure 4:
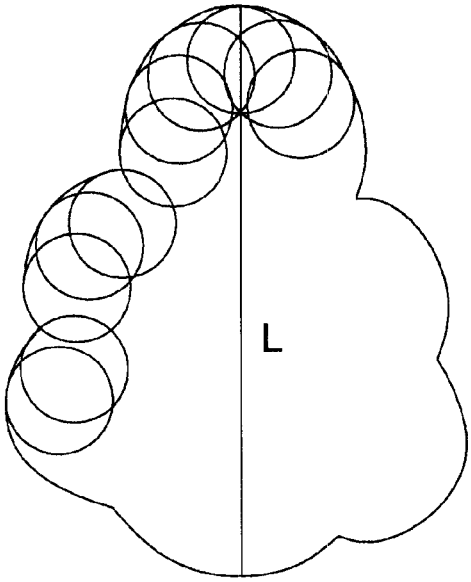
FIG. 4(*a*) is an explanatory drawing of a toner particle having a protrusion, and FIG. 4(*b*) and FIG. 4(*c*) are explanatory drawings of a toner particle having protrusions.
Figure 4:
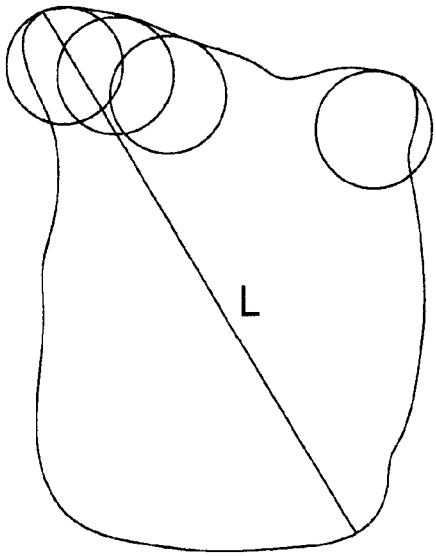
Figure 4:
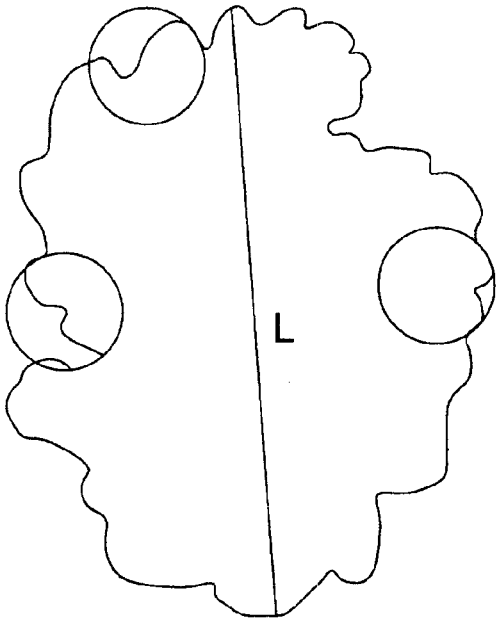

In the above description, "toner particle having no protrusion" means toner particles having substantially not a protruded portion to which electric charge is concentrated or a protruded portion which is easy to wear by a stress; to state it concretely, as shown in FIG. 4(*a*), with the longer diameter of a toner particle denoted by L, when a circle having a diameter of L/10 is made to roll along inside the contour line of the toner particle with a point on the circle kept in contact with the line, in the case where said circle does not substantially jut out to the outside of the contour line of the toner particle, it is called "a toner particle having no protrusion". "The case where said circle does not substantially jut out" means a case where there is one or less protruded portion where the circle juts out. Further, "the longer diameter of a toner particle" means the width of a toner particle having the maximum value of the distance between two parallel lines drawn in contact with a projection image of said toner particle put in between on a plane. Besides, FIG. 4(*b*) and FIG. 4(*c*) respectively show projection images of a toner particle having protrusions.

The measurement of a toner particle having no protrusion was carried out in the following way. First, an enlarged photograph of a toner particle was taken by a scanning electron microscope, and a photographic image of 15,000 magnifications was obtained by further enlargement. Subsequently, the presence or absence of the above-mentioned protrusion was measured with this photographic image. This measurement was carried out for 100 toner particles.

As regards the method of obtaining toner particles having no protrusion, there is no particular limitation. For example, as described in the foregoing concerning the method of controlling the coefficient of shape, they can be obtained by a method in which toner particles are jetted into a heated air flow, a method in which toner particles are repeatedly given a mechanical energy by a impact force in a gas phase, or a method in which toner particles are added in a solvent which does not solve them to get involved in a whirling flow.

Further, in a toner produced by a polymerization method whose particles are formed by making resin particles cohere or fuse-bonded to one another, there are lots of concave and convex portions on the surface of the fuse-bonded particles, and the surface is not smooth; however, by making suitable the conditions such as the temperature, the number of revolutions of the stirring blade, and the stirring time, toner particles having no protrusion can be obtained. These conditions should be varied depending on the property of the resin particles; for example, by making higher the number of revolutions of the stirring blade at a temperature not lower than the glass transition temperature of the resin particle, the surface is made smooth, and toner particles having no protrusion can be formed.

(External Additive Treatment Process):

The toner particles obtained in the above-mentioned way may be used as they are, but for example, for the purpose of improving fluidity, charging characteristic, cleaning performance, also it is appropriate to add the above-mentioned external additive. As regards the method of adding an external additive, various kinds of mixing apparatus known to public such as a turbular mixer, a Henscel mixer, a nouter mixer, and a V-type mixing machine can be used.

(Developer):

A toner of this invention can be used as it is as a non-magnetic or magnetic single-component developer, but it is desirable to use it by mixing with a carrier as a two-component developer.

As regards the particles to be used for a carrier, magnetic particles heretofore known to public such as particles of metals such as iron, and its alloys with aluminum, cobalt, nickel, manganese, etc., and oxides of iron such as ferrite and magnetite can be used, and in particular, ferrite is desirably used. It is appropriate that the above-mentioned magnetic particles have volume average particle size of 15 to 100 $\mu$m, and desirably 25 to 60 $\mu$m. The volume average particle size of a carrier can be measured representatively by a laser-diffraction-type particle diameter distribution measuring apparatus equipped with a wet-type dispersion machine "HELOS" (manufactured by SYMPATEC Corp.). For a carrier, the above-mentioned magnetic particles can be used as they are; however, ones coated by resin, or what is called resin-dispersion-type carrier particles which are composed of fine magnetic particles dispersed in resin are desirable. As regards the resin for coating, there is no particular limitation; for example, olefin resin, styrene resin, styrene/acrylic resin, silicone resin, ester resin, fluorine-contained polymer resin, etc. can be used. Further, for resin to compose resin-dispersion-type carrier particles, there is no particular limitation and any one known to public can be used; for example, styrene/acrylic resin, polyester resin, fluorine-contained resin, phenol resin, etc. can be used.

EXAMPLE

This invention will be further explained on the basis of an example of practice, and of course, this invention should not be limited to this.

(Preparation of Latex)

A solution composed of 7.08 g of an anion surface active agent (sodium dodecilbenzenesulfonate: SDS) dissolved in an ion-exchange water (2760 g) beforehand was put in a separable flask of 5000 ml equipped with a mixing device, a temperature sensor, a cooling tube, a nitrogen introducing device. The internal temperature of the solution was raised to 80° C. while it was being stirred at a stirring speed of 230 rpm in a nitrogen gas flow. Monomer materials including styrene 115.1 g, n-butylacrylate 42.0 g, and methacrylic acid 10.9 g are added together and the temperature was raised to 80° C. for solving, to prepare a monomer solution.

Now, the above-mentioned heated solutions were mixed and dispersed by a mechanical dispersing machine having a circulation path to prepare emulsified particles having a uniform dispersion particle diameter. Subsequently, a solution composed of 0.84 g of a polymerization initiator (potassium persulfate: KPS) dissolved in 200 g of ion-exchange water was added and the mixture liquid was heated and stirred at 80° C. for 3 hours, to prepare latex particles. Further subsequently, a solution composed of 7.73 g of the polymerization initiator (KPS) dissolved in 240 ml of ion-exchange water is added, and after 15 minutes, mixed liquid composed of 383.6 g of styrene, 140.0 g of n-butylacrylate, 36.4 g of methacrylic acid, and 13.7 g of tert-dodecilmercaptan was dropped at 80° C. over 126 minutes. Through heating and stirring for 60 minutes after the completion of dropping, the liquid was cooled to 40° C. to obtain "latex".

Example of Producing Colored Particles 1

An amount 9.2 g of sodium n-dodecilsulfate was dissolved as being stirred in 160 ml of ion-exchange water. An amount 20 g of Regal 330R (carbon black: manufactured by Cabot Corp.) was gradually added into this liquid under stirring, and dispersed by using a Claremix. As the result of measuring the particle diameter in the above-mentioned dispersion liquid by using a electrophoresis light scattering photometer ELS-800 manufactured by Ohtsuka Denshi Co., Ltd. a weight-average particle diameter of 112 nm was obtained. This dispersion liquid is referred to as "coloring agent dispersion liquid".

1250 g of the above-mentioned "latex", 2000 ml of ion-exchange water, and the "coloring agent dispersion liquid" were put in a four-mouth flask of 5 liters equipped with a temperature sensor, cooling tube, nitrogen introducing device, and a stirring device, and the mixture was stirred. After the temperature was adjusted to 30° C., sodium hydroxide solution with a concentration of 5 mol/liter was added to this solution, to adjust the pH value to 10.0.

Subsequently, a solution composed of 52.6 g of sextuple hydrate of magnesium chloride dissolved in 72 ml of ion-exchange water was added under stirring at 30° C. over 10 minutes. Then, after leaving it as it is for 3 minutes, the temperature raising was started, and the temperature was raised to 90° C. in 6 minutes (temperature raising speed=10° C./min). The particle diameter was measured in this state by a Coulter counter TA-II, and at the timing when the volume average particle size become 6.5 μm, an aqueous solution composed of 115 g of sodium chloride dissolved in 700 ml of ion-exchange water was added, to stop the growth of particles, and successively, at the liquid temperature 90° C.±2° C., the solution was heated and stirred for 6 hours; then, the particles were salted out and fused to get bonded to one another. After that, the solution was cooled to 30° C. under the condition 6° C./min, hydrochloric acid was added, to adjust pH to 2.0, and stirring was stopped. The generated colored particles were filtered, and then, they were dried in a warm air flow at 40° C., to give colored particles. The colored particles obtained in the above-mentioned way are referred to as "colored particles 1".

Example of Producing Colored Particles 2

After the above-mentioned "latex" was made to precipitate to cohere, it was dried to become a lump-shaped object, and was melted by heating. To this object, it was mixed and kneaded together an object which has been obtained by removing the surfactant from the above-mentioned "coloring agent dispersion liquid" and drying it to become solid, to obtain a uniform mixture of the coloring agent.

An object obtained by cooling and drying this to a solid one, was pulverized and classified, and colored particles having volume average particle size of 9.0 μm based on a pulverization method were obtained. These particles are referred to as "colored particles 2".

Further, the volume average particle size, the proportion of particles having a coefficient of shape falling within a range of 1.0 to 1.6, and the proportion of the particles having no protrusion of the above-mentioned colored particles 1 and 2 are shown in Table 1 noted below.

TABLE 1

| Coloring agent | Volume average particle size | Proportion (% by number) of particles having a coefficient of shape within a range of 1.0 to 1.6 | Proportion (% by number) of particles having no protrusion | Remarks |
|---|---|---|---|---|
| Colored particles 1 | 6.5 | 70 | 55 | |
| Colored particles 2 | 9.0 | 50 | 40 | For comparison |

In addition, the colored particles 2 are shown as an example for comparison.

Subsequently, hydrophobic silica (number-average primary particle diameter: 12 nm, degree of hydrophobic making: 68) of an amount of 1% by weight and hydrophobic titania (number-average primary particle diameter: 20 nm, degree of hydrophobic making: 63) of an amount of 1.0% by weight were added to the colored particles 1 and 2 respectively, and mixed by a Henshcel mixer to give toners. These are referred to as the toner 1 and the toner 2.

Besides, as regards the measured values of the volume average particle size, coefficient of shape, and proportion of particles having no protrusion, there is no substantial difference between those of colored particles and corresponding toner particles measured.

Ferrite carrier particles coated with silicone resin having a volume average particle size of 60 μm were mixed with both of the above-mentioned toner 1 and toner 2, and developers having a toner concentration of 6% were prepared. These are referred to as the developer 1 and the developer 2 corresponding to the toners respectively.

(Evaluation Test 1):

Now, using prepared developers and a digital copying machine which is basically the same as that shown in FIG. 1, practical copy evaluation of image quality for one hundred thousands copies was carried out.

Especially, in respect of the result of image resolution test, there was a big difference between both toners; according to the result of copying a chart having sets of thin lines drawn to a width of 1 mm, by using the toner 1, resolution up to 10 lines/mm was obtained in the early stage, and resolution up to 8 lines/mm was possible after one hundred thousands copies.

In contrast with this, in the case where the toner 2 was used, resolution was 5 to 6 lines/mm at the start of the test, and it was lowered with the continuing of the practical copy test; after twenty thousands copies, resolution dropped to 3 lines/mm, and therefore, the test was stopped.

From the above-mentioned result, it is understood that if the toner 1 were not used, a good image quality which is required today could not be obtained at all.

Hence, the evaluation after this was carried out by using mainly the toner 1.

(Evaluation Test 2):

By using the toner 1 and the image forming apparatus shown in FIG. 1, three kinds of evaluation tests described below were carried out.

(1) With an image density control device based on a patch image formation attached to the image forming apparatus, it was evaluated whether or not to keep the toner concentration proper is possible.

(2) By using the image forming apparatus in the above-mentioned 1), further a sequence control was practiced in such a way as to make the patch image not overlap the patch image formed in the previous time or the above-mentioned band-shaped image formed over the whole width of the photoreceptor at the specified intervals.

(3) It was made the improvement that, with the image forming apparatus in the above-mentioned (1) equipped with two cleaning devices, image formation was carried out again after the photoreceptor drum was certainly cleaned a plurality of times after a toner image was formed and transferred.

(Result of Evaluation)

1. In the evaluation test of (1), fluctuation was observed in the image density control, and it was found that the cause was due to the fluctuation in the toner concentration detection. When the photoreceptor drum was taken out in the middle of the evaluation test to observe, it was found that the area where a non-transferred high-density image such as a patch image was formed become poorly cleaned. It was understood that, if a patch image was formed on this area, the density of the patch image was regarded as higher than the actual one, and because the toner concentration in the developing device was controlled on the basis of this, fluctuation in image density appeared.

Besides, in the case where the evaluation test was practiced using the toner 2, poor cleaning does not occur, and such a phenomenon was not produced.

2. In the cases of the tests (2) and (3) which were subsequently carried out, the above-mentioned problem was not produced, and a good result was obtained in the both cases.

From the above-mentioned result, if the overlapping of a non-transferred high-density image such as a patch image is prevented as in this invention, even through cleaning done one time, even though it is used a toner having a small particle diameter, a toner composed of uniform particles, or a toner having no protrusion, which has a problem in cleaning performance, cleaning can be performed sufficiently. Hence, it is understood that the advantages these high-image-quality toners have can be exhibited over a long period of time.

By this invention, it is possible to provide an image forming apparatus of an electrophotographic method which is capable of keeping a high image quality over a long period of time without producing poor cleaning, while using a toner having a small particle diameter, a toner composed of particles having a uniform shape, or a toner having no protrusion.

What is claimed is:

1. An image forming apparatus using a toner containing toner particles having a coefficient of shape falling within a range of 1.0 to 1.6 of an amount of at least 65% by number, and having no protrusion of an amount of at least 50% by number, the image forming apparatus comprising:

(a) a charging device for uniformly charging a photoreceptor;

(b) a developing device for developing an image obtained by imagewise exposure with the toner;

(c) a transfer device for transferring a toner image to a transfer material;

(d) a fixing device for fixing the toner image on the transfer material; and (e) a cleaning device for cleaning the photoreceptor after the transfer of a toner image, and carrying out image formation by using repeatedly the photoreceptor after cleaning, wherein when a toner image which is not to be transferred is formed on the photoreceptor, image formation is carried out after a cleaning is done a plurality of times for an area on which the toner image has been formed in a previous image formation process.

2. The image forming apparatus of claim 1, wherein a toner containing toner particles having the coefficient of shape falling within a range of 1.2 to 1.6 of an amount of at least 65% by number is used.

3. The image forming apparatus of claim 1, wherein when a toner image which is not to be transferred is formed on the photoreceptor, image formation is carried out in such a way that the image does not overlap the area on which the toner image has been formed in the previous image formation process.

4. The image forming apparatus of claim 3, wherein a toner containing toner particles having the coefficient of particle shape of 1.2 to 1.6 at least 65% by number is used.

5. The image forming apparatus of claim 1, wherein a toner having a volume average particle size of 2 to 8 $\mu$m is used.

6. The image forming apparatus of claim 5, wherein the volume average particle size of the toner is 3 to 7 $\mu$m.

7. The image forming apparatus of claim 1, wherein a toner having a volume average particle size of 2 to 8 $\mu$m is used, and when a toner image which is not to be transferred is formed on the photoreceptor, image formation is carried out in such a way that the image does not overlap the area on which the toner image has been formed in the previous image formation process.

8. The image forming apparatus of claim 7, wherein the volume average particle size of the toner is 3 to 7 $\mu$m.

9. The image forming apparatus of claim 1, wherein the toner image which is not to be transferred is a patch image for detecting image density, or a band-shaped image extending in a width direction of the photoreceptor formed on at least one of a leading edge portion and a trailing edge portion of an image area.

10. The image forming apparatus of claim 1, wherein the cleaning device comprises a plurality of devices each being operated once for one image formation, which corresponds to that the cleaning is done the plurality of times.

11. The image forming apparatus of claim 1, further comprising an intermediate transferring body on which a toner image is formed.

12. An image forming method using a toner containing toner particles having a coefficient of particle shape falling within a range of 1.0 to 1.6 of an amount of at least 65% by number, and having no protrusion of an amount of at least 50% by number, the image forming method comprising the steps of:

(a) uniformly charging a photoreceptor;

(b) developing an image obtained by imagewise exposure with the toner;

(c) transferring a toner image onto a transfer material;

(d) fixing the toner image on the transfer material; and (e) cleaning the photoreceptor after the toner image is transferred for reuse, wherein when a toner image which is not to be transferred is formed on the photoreceptor, image formation is carried out after the cleaning step is done a plurality of times for an area of the photoreceptor on which the toner image has been previously formed.

13. The image forming method of claim 12, wherein a toner containing toner particles having the coefficient of shape falling within a range of 1.2 to 1.6 of an amount of at least 65% by number is used.

14. The image forming method of claim 12, wherein when a toner image which is not to be transferred is formed on the photoreceptor, an image is formed in such a way that the image does not overlap the area on the photoreceptor on which the toner image has been previously formed in the previous image formation process.

15. The image forming method of claim 14, wherein a toner containing toner particles having the coefficient of shape falling within a range of 1.2 to 1.6 of an amount of at least 65% by number is used.

16. The image forming method of claim 12, wherein a toner having a volume average particle size of 2 to 8 $\mu$m is used, and when a toner image which is not to be transferred is formed on the photoreceptor, an image is formed after the cleaning step is done a plurality of times for an area of the photoreceptor on which the toner image has been previously formed.

17. The image forming method of claim 16, wherein the volume average particle size of the toner is 3 to 7 $\mu$m.

18. The image forming method of claim 12, wherein a toner having a volume average particle size of 2 to 8 $\mu$m is used, and when a toner image which is not to be transferred is formed on the photoreceptor, an image is formed in such a way that the image does not overlap the area on the photoreceptor on which the toner image has been previously formed in the previous image formation process.

19. The image forming method of claim 18, wherein the volume average particle size of the toner is 3 to 7 $\mu$m.

20. The image forming method of claim 12, wherein the toner image which is not to be transferred is a patch image for detecting image density, or a band-shaped image extending in a width direction of the photoreceptor formed on at least one of a leading edge portion and a trailing edge portion of an image area.

21. The image forming method of claim 12, wherein the cleaning device comprises a plurality of cleaning devices each being operated once for one image formation, which corresponds to that the cleaning step is done the plurality of times.

22. The image forming method of claim 12, wherein further comprising an intermediate transferring body on which a toner image is formed.

* * * * *